US005782358A

United States Patent [19]

Walker

[11] Patent Number: 5,782,358

[45] Date of Patent: Jul. 21, 1998

[54] CONTAINER

[76] Inventor: Kenneth C. Walker, 116 Westwood Lane, Richmond Hill, Ontario, Canada, L4C 6Y3

[21] Appl. No.: 413,320

[22] Filed: Mar. 30, 1995

[51] Int. Cl.[6] ..... B65D 77/00

[52] U.S. Cl. ..... 206/509; 220/23.4; 220/710

[58] Field of Search ..... 220/23.4, 23.6, 220/258, 356, 710; 206/509

[56] References Cited

U.S. PATENT DOCUMENTS

| | | | |
|---|---|---|---|
| 2,631,747 | 3/1953 | Stolte . | |
| 2,641,374 | 6/1953 | Der Yuen . | |
| 2,960,248 | 11/1960 | Kuhlman . | |
| 3,374,917 | 3/1968 | Troy . | |
| 3,391,824 | 7/1968 | Wiseman . | |
| 3,874,554 | 4/1975 | Chang . | |
| 4,127,207 | 11/1978 | Hubert et al. . | |
| 4,538,741 | 9/1985 | Jacobs | 220/306 X |
| 4,656,840 | 4/1987 | Loofbourrow . | |
| 4,691,828 | 9/1987 | Slusarczyk . | |
| 5,007,551 | 4/1991 | Baroi . | |
| 5,052,568 | 10/1991 | Simon | 220/258 X |
| 5,052,614 | 10/1991 | Xuan | 220/710 X |
| 5,054,631 | 10/1991 | Robbins, III . | |
| 5,078,286 | 1/1992 | Hashimoto . | |

*Primary Examiner*—Steven M. Pollard
*Attorney, Agent, or Firm*—Ridout & Maybee

[57] ABSTRACT

A cubic plastic container has a cylindrical neck formed centrally in its top defining a mouth for the container. The top of the neck is provided with a collar capable of receiving a snap fitting cap. The container also has circular recesses formed centrally in its bottom and two opposing sides. The recesses are sized to snuggly, but releasably, receive the neck of another such container so that the two containers may be coupled by the engagement of the collar of one container with the sidewall of the recess of the other container.

10 Claims, 2 Drawing Sheets

CONTAINER

The invention is a container for food. In particular, the container is for beverages, preferably for a single serving of a beverage.

The market for single serving beverages has grown tremendously in recent years with the advent of the drink box. The drink box, however, has a number of disadvantages and problems associated with it. Drink boxes are rectangular parallelepiped structures made of a paper-based material, and as such lack inherent structural strength. This lack of strength poses a problem for the storage and transport of drink boxes, as they are vulnerable to crushing. The drink box is accessed by puncturing a membrane, such as a metal foil, with a plastic straw having a pointed end. Because the box is flexible, particularly at its two large rectangular sides, care must be taken not to squeeze the box when it is initially accessed with the straw (as all parents of young children well know). Drink boxes are not resealable, so a box with a partially consumed contents is usually discarded rather than saved. The great increase in drink box usage of late has raised environmental concerns as these boxes are not currently recyclable.

These and other problems are addressed by the present invention which provides a cubic plastic container having a cylindrical neck formed centrally in its top which is provided with a collar capable of receiving a snap fitting cap. The container also has circular recesses formed centrally in its bottom and two opposing sides. The recesses are sized to snuggly, but releasably, receive the neck of another such container so that the two containers may be coupled by the engagement of the collar of one container with the sidewall of the recess of the other container.

The container 10 of the invention is cubic, and hence, possesses the inherent structural strength of a cube. Preferably, the container 10 is made of a recyclable plastic such as polyethylene. Accordingly, the container 10 can be blow molded using a polyethylene known generically as PET #1, which is a material used commonly for food containers and is recognised as being fully recyclable.

Figure 1:
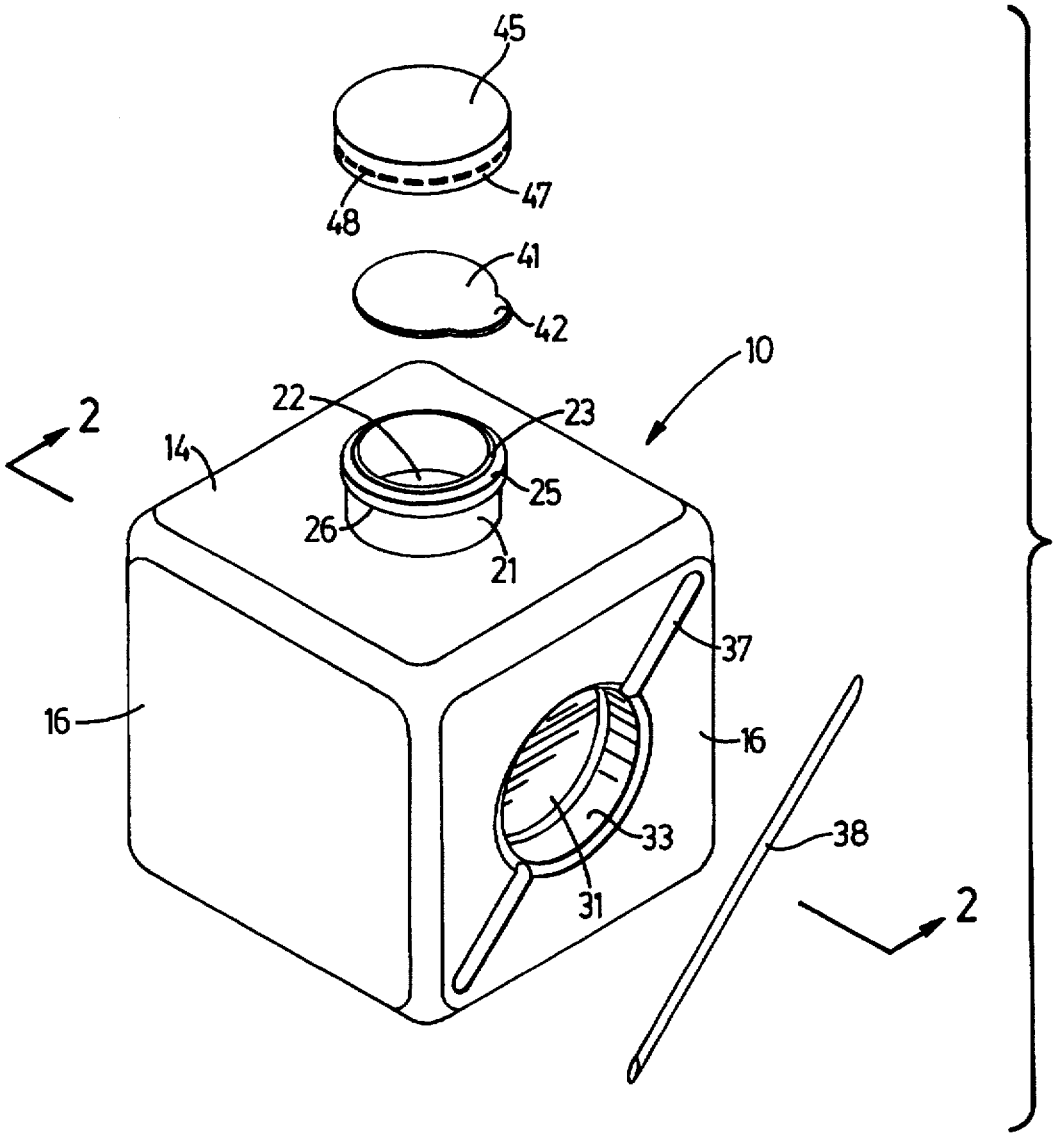
FIG. 1 is a perspective view of the container of the invention.
Figure 2:
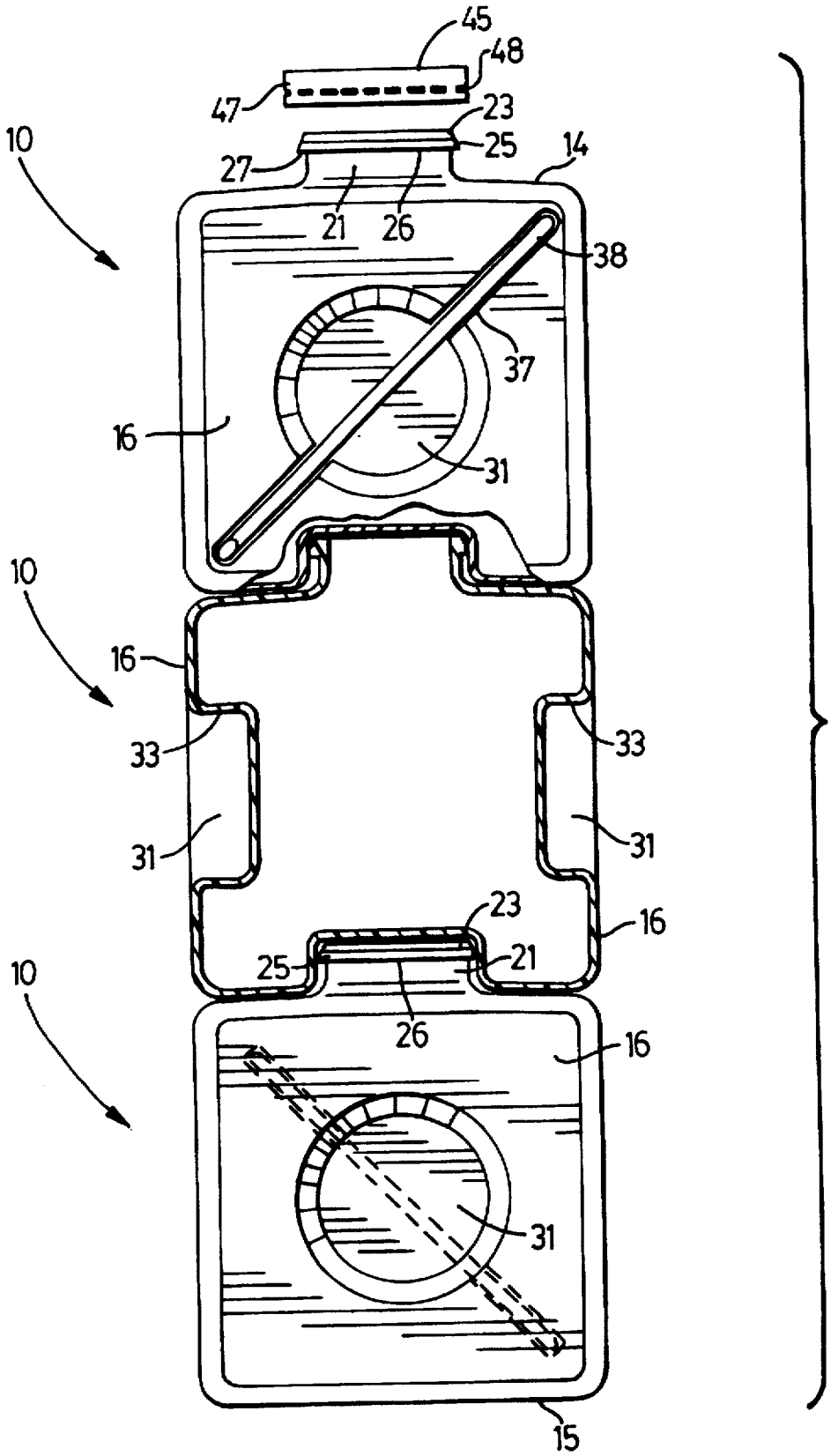
FIG. 2 is a side elevational view of three containers stacked atop one another and a cross sectional view of one of the containers.

The container 10 has a top 14, a bottom 15 and four sides 16, all of which are equally dimensioned squares. A cylindrical neck 21 is formed centrally in the top 14, thereby defining a circular opening or mouth 22 for the container 10. The neck 21 has an upper rim 23 from which extends a collar 25. The collar 25 has a lower edge 26 spaced outwardly from the neck 21, and preferably, the collar 25 includes a flange 27 extending from the edge 26 to the neck 21 (FIG. 2).

The bottom 15 and two opposing sides 16 each have a circular recess 31 formed centrally therein. Each recess 31 has a cylindrical sidewall 33, and each recess 31 and the neck 21 with collar 25 are sized to allow containers 10 to be coupled together by engaging the neck 21 of one container 10 in a recess 31 of another container 10. In this regard, each recess 31 is sized so that the collar 25 of another container 10 may snuggly engage the sidewall 33 of the recess 31 (FIG. 2).

Preferably, one side 16 having a recess 31 is also provided with a groove 37 for storing a straw 38. Conveniently, the groove preferably extends diagonally across the face of the side 16 intersecting the recess 31. This arrangement allows for the straw 38 to be readily removed manually from the groove 37. The mouth 22 of the container 10 defined by the rim 23 is preferably closed after filling by means of a sheet-form lid 41 which is sealed to the rim 23. The sheet-form lid 41 may be of any suitable material such as plastic, paper, metal foil or a composite of these. The lid 41 preferably has at least one area capable of penetration by a plastic straw having a sharpened end. Alternatively, the lid 41 may include a tab 42 or similar structure to enable its partial or complete removal from the rim 23. Indeed, this latter arrangement may be preferred for most applications.

The structure of the collar 25 on the neck 21 enables the mouth 22 of the container 10 to be capped if the contents of the container 10 are only partially consumed. Thus, a cap 45 has a skirt 47 with an inwardly extending rib 48 sized to provide a releasable snap engagement of the cap 45 over the mouth 22, whereby the inwardly extending rib 48 engages the collar 25 when the cap 45 is snap fit in place. Preferably, the cap 45 is made of a plastic which is compatible with the plastic of the container 10.

While the container 10 may be of any size appropriate for the purpose, the container 10 has particular advantages for single serving beverage applications. The container 10 can be sized to contain 300 ml of a beverage, such as a fruit drink. The cube shape of the container 10 allows single containers to be stored on a refrigerator shelf and carried in a lunch box or the like conveniently. When the contents of the container 10 have been consumed, the container 10 can be recycled. Also, the empty containers 10 can be used as children's interlocking building blocks by virtue of the releasable coupling feature described.

The container 10 has advantages from a manufacturing point of view as blow molded plastic articles of this type may be readily and inexpensively produced in large quantities. Blow molding allows the corners and edges of the container 10 to be rounded which provides a further safety advantage in relation to the use of such containers by children.

After filling and sealing the containers 10, they may be conveniently assembled into packs of 27, i. e., nine columns of three stacked containers 10. This cube of 27 containers 10 can be shrink wrapped for distribution and sale without the need to provide additional structure. In contrast, the conventional paper drink box is distributed and sold in case flats of 27, in which groups of three boxes are shrink wrapped together, and further requiring the added structure of a cardboard flat in combination with an overall shrink wrap of the assembled case lot. The drink box flat has no handle or other convenient means for one handed carrying. The 27 container cube of the invention can easily be equipped with a handle or strap to facilitate one handed carrying. The 27 cube case lot of containers 10 of the invention provide a strong assembly for storage and transport, thus largely alleviating the problem of losses due to crushing. As a single serving container having a volume of 300 ml, the container 10 will be about 67–70 mm cubed (about 2.75 inches along each edge). The neck 21 preferably has a height of about 10 mm and the mouth 22 a diameter of about 25 mm. The skilled person will appreciate, however, that the dimensions of the container 10 may be varied to accommodate a particular application.

I claim:

1. A cubic plastic container having a top, a bottom, and four sides, comprising:

a cylindrical neck formed centrally in the top, the neck defining a mouth for the container, the mouth having a circular rim from which extends a collar having a lower edge spaced outwardly from the neck;

the bottom and two opposing sides each have a circular recess formed centrally therein, the recess having a cylindrical sidewall and being sized to snuggly, but releasably, receive the neck of another such container so that the two containers are coupled by the engagement of the collar of one container with the sidewall of the recess of the other container; and an elongate groove in a side having a circular recess, the groove intersecting the recess and being sized to releasably store a straw.

2. A container as claimed in claim 1, wherein the collar includes a flange extending about the neck to the lower edge of the collar.

3. A container as claimed in claim 1, wherein the groove extends diagonally across the face of the side.

4. A container as claimed in claim 1, wherein a lid is sealed about the opening defined by the neck.

5. A container as claimed in claim 4, wherein the lid is a sheet of plastic, paper, metal foil or a composite material.

6. A container as claimed in claim 5, wherein the lid is heat sealed about the opening of the neck and the lid being structured to allow it to be punctured by a plastic straw having a point formed at one end thereof.

7. A container as claimed in claim 1, further comprising a circular cap having a skirt with an inwardly extending rib sized to provide a releasable snap engagement of the cap over the mouth of the neck, whereby the inwardly extending rib of the cap engages the collar of the neck when the cap is snap fit in place.

8. A container as claimed in claim 7, wherein the cap is made of a plastic.

9. A container as claimed in claim 1, wherein the plastic is polyethylene.

10. A container as claimed in claim 1, having a volume of about 300 ml.

* * * * *